US007228692B2

(12) United States Patent
Concha et al.

(10) Patent No.: US 7,228,692 B2
(45) Date of Patent: Jun. 12, 2007

(54) DEFROST MODE FOR HVAC HEAT PUMP SYSTEMS

(75) Inventors: Julio Concha, Rocky Hill, CT (US); Yu Chen, East Hartford, CT (US); Young Kyu Park, Simsbury, CT (US); Tobias H. Sienel, East Hampton, MA (US)

(73) Assignee: Carrier Corporation, Syracuse, NY (US)

( * ) Notice: Subject to any disclaimer, the term of this patent is extended or adjusted under 35 U.S.C. 154(b) by 228 days.

(21) Appl. No.: 10/776,374

(22) Filed: Feb. 11, 2004

(65) Prior Publication Data

US 2005/0172648 A1 Aug. 11, 2005

(51) Int. Cl.
*F25D 21/06* (2006.01)

(52) U.S. Cl. ..... 62/151; 62/154; 62/155; 62/156

(58) Field of Classification Search ..... 62/151, 62/154, 155, 156, 238.1, 238.6, 238.7, 277, 62/278

See application file for complete search history.

(56) References Cited

U.S. PATENT DOCUMENTS

| | | | |
|---|---|---|---|
| 4,573,326 | A | 3/1986 | Sulfstede |
| 5,319,943 | A | 6/1994 | Bahel et al. |
| 5,438,844 | A | 8/1995 | Hoglund et al. |
| 5,797,273 | A | 8/1998 | Guo |
| 6,318,095 | B1 | 11/2001 | Guo et al. |

(Continued)

FOREIGN PATENT DOCUMENTS

| | | |
|---|---|---|
| EP | 0161338 | 11/1985 |
| JP | 58179764 | 10/1983 |
| JP | 2002195698 | 7/2002 |

(Continued)

OTHER PUBLICATIONS

International Search Report, Mar. 1, 2006.

*Primary Examiner*—Cheryl Tyler
*Assistant Examiner*—Gene Bankhead
(74) *Attorney, Agent, or Firm*—Carlson, Gaskey & Olds

(57) ABSTRACT

A heat pump, and in particular a heat pump for heating a hot water supply is provided with an improved defrost mode. The defrost mode is actuated to remove frost from an outdoor evaporator that may accumulate during cold weather operation. An algorithm for operation of the defrost mode is developed experimentally by seeking to maximize the heat transfer provided by the refrigerant. A heating system condition is experimentally related to the heat transfer capacity. One then maximizes the average heat transfer capacity to determine the optimum initiation point for the defrost mode. Further, protections are included into the defrost mode. When the heat pump is utilized to heat hot water, methods are provided to prevent the water that remains in the heat exchanger from becoming unduly heated. In one method, the water pump may be periodically operated to move the water. In a second method, a control ensures the discharge pressure of the refrigerant leaving the compressor is reduced, and that the water pump is not stopped until that reduced temperature falls below a predetermined maximum. The temperature reduction is achieved through a dual control loop wherein a temperature that is too high results in a new desired discharge pressure. The control achieves the new desired pressure by controlling the expansion device. In another protection feature, as a control determines that the defrost mode is nearing its end, an evaporator fan is run to remove melted water from the evaporator coils, and also to ensure the refrigerant leaving the evaporator does not reach unduly high pressure or temperatures.

15 Claims, 1 Drawing Sheet

U.S. PATENT DOCUMENTS 6,418,737 B1 7/2002 Kuroki

FOREIGN PATENT DOCUMENTS

| | | |
|---|---|---|
| JP | 2002243276 | 8/2002 |
| JP | 2002310497 | 10/2002 |
| JP | 2002310519 | 10/2002 |
| JP | 2002372326 | 12/2002 |
| JP | 2003056907 | 2/2003 |
| JP | 2003130560 | 5/2003 |
| JP | 2003139392 | 5/2003 |
| JP | 2003139405 | 5/2003 |
| WO | WO02/18854 | 3/2002 |
| WO | WO03/064935 | 1/2003 |
| WO | WO 03/064942 | 1/2003 |
| WO | WO03042606 | 5/2003 |

DEFROST MODE FOR HVAC HEAT PUMP SYSTEMS

BACKGROUND OF THE INVENTION

This invention relates to several improvements for determining when to initiate a defrost mode for a heat pump, and also to protect associated systems such as a hot water supply system during a defrost mode.

Heating, ventilation and air conditioning (HVAC) systems are utilized to provide cooling and heating in buildings. Typically, a compressor delivers a refrigerant to a heat exchanger which is a heat exchanger associated with the interior of a building. The refrigerant passes to an expansion device downstream of the heat exchanger, and downstream of the expansion device to an evaporator. The evaporator is typically a heat exchanger that exchanges heat with an outside environment.

When an HVAC system is utilized to provide heating, it can be said to be in a heat pump mode. Under such conditions, the evaporator may be in a very cold environment, such as during winter. Problems can arise in that frost can form on the evaporator heat exchanger coils. This lowers the ability to transfer heat from the system to the outside environment through the evaporator heat exchanger.

Thus, such systems have a defrost mode. In defrost mode, the hot refrigerant leaving the compressor is bypassed directly to the evaporator. The bypass can occur by reducing the removal of heat in the heat exchanger, or can be a bypass of some refrigerant around the heat exchanger. To date, there has been little in the way of sophisticated control to determine how and when the defrost mode should be actuated.

Moreover, when a heat pump system is utilized to heat water, such as for a hot water heating system, problems can arise during defrost mode. In particular, defrost mode is often utilized in combination with shutting down the pumping of water through the heat exchanger. This is done since if the water continues to flow, the refrigerant will be cooled in the heat exchanger. Under such conditions, the water that sits in the heat exchanger can boil, which would be undesirable.

Another problem can occur near the end of a defrost mode. At this point, the bulk of the frost will have melted. There are water droplets remaining on the coil. Since the fan is turned off, there is no air removing these droplets. Leaving the droplets on the coil increases the likelihood that the coil will quickly frost again after the termination of the defrost mode. Further, since the fan is not driving air over the coil, little heat is being removed from the refrigerant in the coil. Thus, the refrigerant temperature exiting the evaporator remains higher than might be desired.

SUMMARY OF THE INVENTION

In a disclosed embodiment of this invention, a method of determining the most optimum times for initiating defrost operation is disclosed. In particular, the operating range of the system capacity for heating water is plotted against some system variable. A most optimum operation algorithm is then developed experimentally by looking at the graph of capacity compared to that variable. The initiation of defrost mode is identified as optimally occurring at a point wherein the average capacity provided is maximized.

Moreover, protection for the water remaining in the heat exchanger during a defrost mode is also disclosed. The protection may take the form of periodically operating the water pump during defrost mode to remove the water in the heat exchanger such that it is not subject to the high refrigerant heat for an undue length of time. Alternatively, the water pump may not be stopped until the refrigerant temperature is lowered to a point such that the water would tend not to boil. That is, some method for beginning to lower the refrigerant temperature at the compressor outlet can be initiated such that before the water pump is stopped, the refrigerant temperature has lowered below the boiling point of water. In a preferred embodiment, the regulation of the refrigerant temperature is done with a dual (or nested) control loop. A first control loop compares the actual temperature to a target temperature, and determines a new refrigerant discharge pressure for the compressor based upon the difference between the target and actual refrigerant temperature. The second portion of the control loop achieves that new target pressure by controlling the expansion device. The use of the dual control loop provides a smoother transition than a single direct control loop would provide. Abrupt pressure variation is avoided, which will extend the life of the circuit components. Further, this control loop will allow the discharge temperature to be maintained accurately near the target value, which will minimize the defrost time.

Another feature is utilized, particularly near the end of a defrost cycle, to blow air over the evaporator coils. Typically, during a defrost cycle, the fan is stopped, as blowing air over the evaporator coils tends to remove heat to the air which would be better utilized to melt the frost. However, by beginning to utilize the fan at least near the end of the defrost cycle, the melted water droplets can be taken away. Moreover, as the water begins to melt, if the temperature is not lowered, such as by air, the temperature of the refrigerant leaving the evaporator can begin to reach unduly high temperatures. This could result in problems elsewhere within the system.

Finally, a number of distinct system variables are disclosed as being useful for identifying when to begin and end a defrost cycle.

These and other features of the present invention can be best understood from the following specification and drawings, the following of which is a brief description.

DETAILED DESCRIPTION OF THE PREFERRED EMBODIMENT

Figure 1:
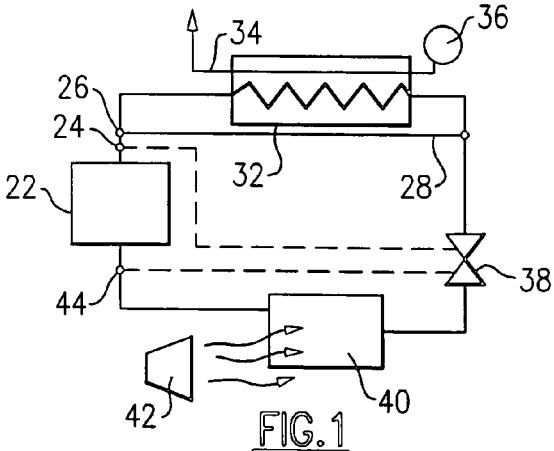
FIG. 1 is a schematic view of a heat pump system for providing heated water.

A heat pump cycle 20 is illustrated schematically in FIG. 1. As known, a compressor 22 compresses a refrigerant and discharges the refrigerant downstream toward heat exchanger 32. As shown, a sensor 24 is positioned on this downstream line. Further, a valve 26 selectively allows the flow into a bypass line 28, which will bypass a portion of the refrigerant to a downstream point 30, bypassing the heat exchanger 32. Bypass line 28 is optional, and is a component to provide a defrost function as will be explained below. A hot water line 34 passes in heat exchange relationship with the refrigerant in the heat exchanger 32. A hot water pump 36 drives the flow of the water through the heat exchanger 32.

An expansion device 38 is positioned downstream of the heat exchanger 32, and an evaporator 40 is downstream of the expansion device 38. Typically, the evaporator 40 includes heat transfer coils. A fan 42 blows air over the evaporator 40 to heat the refrigerant in the evaporator. Downstream of evaporator 40, the refrigerant returns to the compressor 22. As shown, a sensor 44 may be optionally positioned to sense a condition of the refrigerant approaching the compressor 22.

As known, the heat pump cycle 20 operates to heat water in the water supply line 34. Refrigerant is compressed at compressor 22, and is hot when entering heat exchanger 32. In heat exchanger 32, this hot refrigerant transfers heat to the water in water supply line 34. Pump 36 drives the water through the heat exchanger 32, and to a downstream use for the hot water. The refrigerant leaving the heat exchanger 32 is expanded by the expansion device 38, and then passes to the evaporator 40, and heat is transferred with the outside environment at evaporator 40.

The present invention is directed to solving some challenges in operating the cycle 20. In particular, the evaporator 40 is outside and exposed to the environment. During cold temperature, frost may accumulate on the heat transfer coils. This reduces the ability to remove heat from the refrigerant in the evaporator 40, and thus lowers the capacity of system 20 to deliver heat to the hot water 34. Thus, defrost modes are known.

In a defrost mode, hot refrigerant is directed through the evaporator 40 to melt the frost. The hot refrigerant is delivered to the evaporator 40 in one of two basic ways in the prior art. First, the valve 26 may be opened to bypass refrigerant through line 28 and around the evaporator 32. Typically, not all of the refrigerant is bypassed, and some does continue to move through the evaporator 32. Alternatively, (or in conjunction with the bypass), the pump 36 may be stopped. Since water is no longer driven through the heat exchanger, the refrigerant passing through the heat exchanger tends to remain hot. Thus, hot refrigerant approaches the evaporator 40. Typically, in the prior art defrost mode, the fan 42 is also stopped during the defrost mode.

As mentioned above, there are design challenges with the defrost mode. In particular, the defrost mode has typically not been operated in a very efficient manner. There are also challenges with regard to unduly heating water in the line 34 during defrost mode, and also resulting in unduly high refrigerant temperature leaving the evaporator 40 as the defrost comes to a close and the frost has all been melted.

Figure 2B:
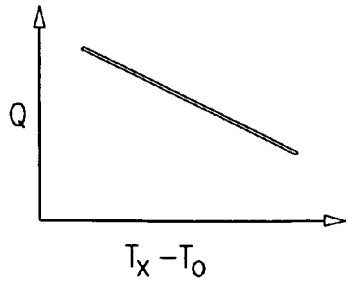
FIG. 2B is a graph of a system condition.
Figure 2A:
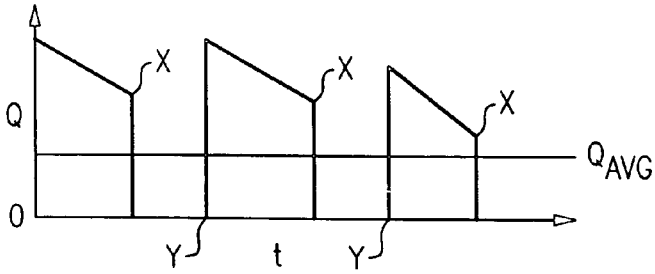
FIG. 2A is a graph of capacity for the inventive system.

FIG. 2A schematically shows the quantity of heat that can be delivered into the water by the system 20, and how that quantity would change with time. As shown, periodically, defrost modes are initiated. There is little or no heat transfer during a defrost mode typically. Thus, the defrost mode itself lowers the total heat flow into the water. On the other hand, as can be appreciated from the graph, with time, the quantity of heat delivered into the water drops as frost builds up on the evaporator 40. The present invention seeks to maximize an average heat transfer $Q_{AVG}$ by optimizing the timing of the defrost mode to ensure maximum heat transfer.

As shown in FIG. 2B, some system quantity such as the difference between outdoor temperature and the temperature sensed by sensor 44 may be experimentally plotted against the quantity of heat provided. As can be seen in FIG. 2B, the heat transfer provided will drop off as the difference between outdoor temperature $T_O$ and the temperature at sensor 44 $T_X$ increases. That is, as frost builds up on the evaporator, the temperature of the refrigerant in the evaporator tends to be reduced less than if good heat transfer were occurring. A plot such as shown in FIG. 2B is developed experimentally and then utilized to maximize the average heat transfer such as is illustrated in FIG. 2A. Generally, if the defrost cycles are too frequent, then the system loses available heat transfer. On the other hand, if the defrost cycles are too infrequent, the slope of the heat transfer drops off such that little heat transfer is occurring. Thus, a chart such as utilized in FIG. 2A is used in conjunction with the concepts illustrated in FIG. 2B to maximize $Q_{AVG}$. A worker of ordinary skill in the art would recognize how to perform such a maximization.

Assuming that the graph of FIG. 2A is an optimum cycle, a point X can be shown which would be the optimum point to initiate a defrost mode. A system monitoring some system condition will associate that system condition with point X.

The system condition utilized to define point X can be any one of several. For example, the temperature difference between outdoor air and the refrigerant at the low pressure side (i.e., as sensed by sensor 44) can be utilized to determine defrost initiation, and monitored to identify when the circuit has reached point X. When the temperature differential exceeds a defrost initiation value, then defrost operating mode is initiated. Also, the temperature of the refrigerant at sensor 44, or elsewhere on the low pressure side, can be used to determine defrost initiation. When this temperature drops below a defrost initiation value, then point X may be identified, and defrost mode initiated.

Further, the pressure of the refrigerant on the low side, or at sensor 44 can be utilized to determine point X and initiate defrost. When the pressure drops below a defrost initiation value, defrost mode may be initiated. Also, the water flow rate through the sensor 32 can be utilized to identify point X, and begin defrost operating mode. Similarly, if the water pump 36 is variable speed, the control signals can be utilized to determine defrost initiation. A system co-efficient of performance can be utilized to determine defrost initiation. The co-efficient of performance can be monitored, and when it drops below a defrost initiation value, defrost mode may be initiated.

Point Y can be determined based upon several system conditions also. As an example, the temperature of the refrigerant at sensor 44 may also be utilized to determine defrost conclusion. When the temperature exceeds a defrost conclusion value, defrost operating mode can be concluded and point Y identified. Also, the pressure of the low side refrigerant can be utilized to determine point Y, and defrost conclusion. As one further example, the temperature difference between the refrigerant on the low side (i.e., center 44) and outdoor air temperature can be utilized to determine defrost conclusion. When this temperature differential exceeds a defrost conclusion value, defrost operating mode may be concluded.

When the system reaches point X, then defrost mode is initiated. When defrost mode ends, the system condition reaches point Y. Again, these conditions could be developed experimentally.

Further, the duration of the defrost mode could simply be based upon a timer. In this sense, the "approaching the end" of defrost mode would simply be based upon expired time. Also, some of the above-referenced methods, such as the protection to minimize the likelihood of water being unduly heated in the heat exchanger, or the operation of the fan, could extend to the existing defrost modes, wherein the defrost is simply actuated such as periodically, etc.

As mentioned above, during defrost mode, the water pump 36 is typically stopped. Thus, water is not moving through the heat exchanger in line 34, but instead a quantity of water remains stored in the heat exchanger. This water could be superheated to a boiling point if left alone. The present invention thus protects against unduly hot water. Two methods have been developed. First, the water pump 36 may be periodically run during defrost mode to move the water through the heat exchanger. Thus, while the water pump will generally be stopped for the bulk of the time during defrost mode, it will be intermittently run such that the water is cycled through the heat exchanger. This will prevent the water from becoming unduly hot.

The second method of preventing the water from boiling may be used alternatively, or could be used in conjunction with the periodic running of the water pump. In the second method, the sensor 44 senses the pressure or temperature of the refrigerant downstream of compressor 22. The water pump 36 is not stopped in defrost mode until that discharge refrigerant quantity drops to a predetermined amount which would be indicative of the refrigerant temperature being below the boiling point of the water in the line 34. As known, the pressure or temperature can be reduced by opening the expansion device 38 to lower the pressure approaching the compressor, and hence the discharge pressure. By so doing, the present invention ensures that when the water pump 36 is stopped, the temperature of the refrigerant will be sufficiently low (i.e., below the boiling point), and the problem mentioned above will not occur.

Figure 3A:
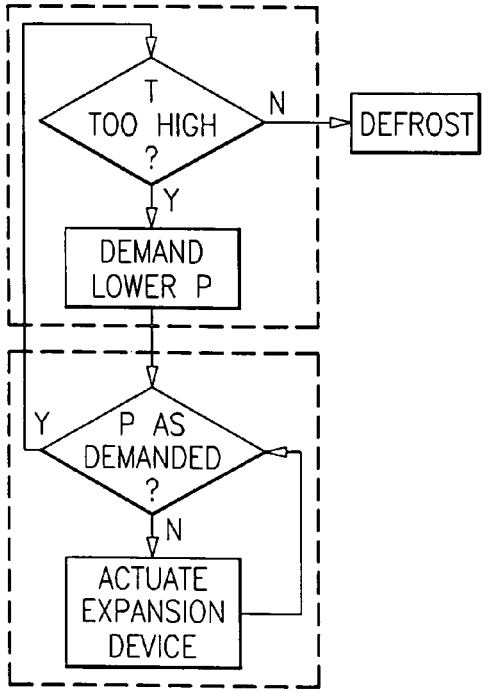
FIG. 3A shows a flow chart for a control feature.

As shown in FIG. 3A, a control for performing the above temperature adjustment steps asks if the temperature of the refrigerant at the discharge of the compressor is too high. If not, then the defrost mode may be actuated. If the temperature is too high, then a lower target discharge pressure is determined which will in turn result in a lower compressor discharge temperature. A second control loop receives that target discharge pressure, and compares the actual discharge pressure to the target. If the actual discharge pressure meets the target, then the flow chart returns to the first control loop to compare the actual refrigerant discharge temperature to the target. However, if the actual discharge pressure is different than the target, then the expansion device is controlled with known algorithms to achieve a new pressure. The use of this dual or nested control loop achieves a smoother change in the pressure, which will eliminate sharp pressure pulses. Moreover, the dual loop assures that the temperature can be accurately maintained very close to the target temperature, while still insuring the target temperature is not exceeded.

Another feature of a defrost mode is that the fan 42 is typically stopped. As mentioned above, there are problems with this in that the water droplets of the melted frost remain on the heat transfer fins, and could easily frost again once defrost mode is stopped. Moreover, as the defrost mode approaches its end, too little heat is being removed from the evaporator in that air is not being driven over the fins. Thus, the refrigerant pressure and temperature approaching the compressor become unduly high, and can result in additional system problems. One control option to address this concern is to further open the expansion valve 38 to lower refrigerant temperature. However, under some system conditions, this would require an unduly large expansion valve that would add to costs.

Thus, the present invention avoids the problem of undue refrigerant temperature or pressure downstream of evaporator 40 by periodically turning on the fan 42. Most preferably, when it is learned that the defrost mode is nearing its end, the fan 42 is started. Preferably, a control monitors the system condition that is being monitored to identify point Y. As the condition approaches Y and is within some predetermined amount, the control will begin operation of fan 42, as it senses the defrost mode is nearing a conclusion. This provides two benefits. First, the water droplets which are melted on the heat transfer coils, etc., are removed by this air being blown over them. Secondly, the refrigerant is cooled by the flowing air, and does not approach unduly high pressures or temperatures.

Figure 3B:
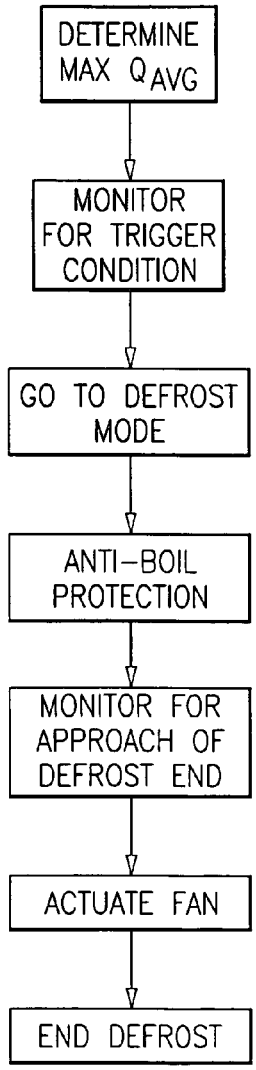
FIG. 3B is a flowchart of the inventive system.

As shown in FIG. 3B, a flowchart of this invention includes the steps of first determining the best average time and spacing for the defrost cycle, that is the charts such as shown in FIG. 2A. Second, the system condition is monitored, and when the point X is reached, defrost mode is initiated. During defrost mode, water boil protection occurs. Finally, when it is determined that defrost mode is approaching its end point (Y), the fan is turned on.

Each of the several features mentioned above can be utilized in combination or separately. Controls for controlling all of the various components in the cycle 20 are known. Such controls are operable to control the various components. A worker of ordinary skill in the art would recognize how to provide control to achieve the above-referenced methods and functions.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A heat pump cycle comprising:

a compressor for compressing a refrigerant;

a heat exchanger downstream of said compressor;

a main expansion device downstream of said heat exchanger;

an evaporator downstream of said main expansion device, and a refrigerant flowing from said compressor to said heat exchanger, to said expansion device, to said evaporator, and returning to said compressor;

a control for said cycle, said control being operable to control components and initiate a defrost mode at which refrigerant from a discharge side of said compressor is cycled into said evaporator at a relatively hot temperature to defrost said evaporator, said control being operable to initiate said defrost mode based upon an algorithm developed to maximize heat transfer from said heat pump to an environment to be heated:

said environment to be heated is a hot water supply, and a water pump drives cooler water through said heat exchanger to be heated by said refrigerant, with said water pump being stopped during defrost mode;

said control operating to minimize the likelihood of water being heated unduly by hot refrigerant in said heat exchanger during defrost mode, said water pump being actuated intermittently to minimize said likelihood; and said water pump being stopped during defrost mode, but said water pump does not stop until said control has determined that a discharge temperature of said refrigerant has dropped below a predetermined maximum to minimize said likelihood.

2. The cycle as set forth in claim 1, wherein an actual discharge temperature is compared to said predetermined maximum, and if said actual discharge temperature exceeds the predetermined maximum, a new target refrigerant pressure is determined, and said control controlling said expansion device to achieve said new target pressure.

3. The cycle as set forth in claim 1, wherein a fan drives air over said evaporator, said fan being stopped during said defrost mode.

4. The cycle as set forth in claim 3, wherein said fan is actuated at least when said control determines said defrost mode is nearing an end point.

5. The cycle as set forth in claim 1, wherein said control determines said control algorithm experimentally to increase average heat transfer.

6. The cycle as set forth in claim 5, wherein a system condition developed for said experimental relationship is the difference between outdoor temperature and a temperature downstream of said evaporator.

7. The cycle as set forth in claim 1, wherein initiation of said defrost mode is based upon at least one system condition chosen from the group of refrigerant temperature, refrigerant pressure and outdoor temperature.

8. The cycle as set forth in claim 1, wherein said defrost mode includes opening a bypass to bypass a portion of a refrigerant downstream of said compressor around said heat exchanger.

9. A heat pump cycle comprising:

a compressor for compressing a refrigerant;

a heat exchanger downstream of said compressor;

a main expansion device downstream of said heat exchanger;

an evaporator downstream of said main expansion device, and a refrigerant flowing from said compressor to said heat exchanger, to said expansion device, to said evaporator, and returning to said compressor;

a fan for blowing air over said evaporator;

a hot water supply to be heated in said heat exchanger and a water pump for moving water through said heat exchanger;

a control for said cycle, said control being operable to control components and initiate a defrost mode at which refrigerant from a discharge side of said compressor is cycled into said evaporator at a relatively hot temperature to defrost said evaporator, said control being operable to initiate said defrost mode based upon an algorithm developed to maximize heat transfer from said heat pump to an environment to be heated, said control also being operable to stop said water pump during defrost mode and operates to minimize the likelihood of water in said heat exchanger being unduly heated during defrost mode, said control also stopping said fan during defrost mode, and monitoring system conditions to identify an approaching end of said defrost mode, and actuating said fan to begin blowing air over said evaporator prior to an end of said defrost mode; and said water pump being stopped during defrost mode, but said water pump does not stop until said control has determined that a discharge temperature of said refrigerant has dropped below a predetermined maximum to minimize said likelihood.

10. The cycle as set forth in claim 9, wherein said water pump is actuated intermittently to minimize said likelihood.

11. The cycle as set forth in claim 9, wherein said defrost mode includes opening a bypass to bypass a portion of a refrigerant downstream of said compressor around said heat exchanger.

12. The cycle as set forth in claim 1, wherein said algorithm includes defining an optimum point to initiate defrost mode based upon a temperature difference between outdoor air, and a refrigerant temperature.

13. The cycle as set forth in claim 1, wherein the algorithm includes utilizing a refrigerant pressure to determine a point for beginning the defrost cycle.

14. The cycle as set forth in claim 9, wherein said algorithm includes defining an optimum point to initiate defrost mode based upon a temperature difference between outdoor air, and a refrigerant temperature.

15. The cycle as set forth in claim 9, wherein the algorithm includes utilizing a refrigerant pressure to determine a point for beginning the defrost cycle.

* * * * *